US006112661A

United States Patent [19]

Albiez

[11] Patent Number: 6,112,661

[45] Date of Patent: Sep. 5, 2000

[54] INK KNIFE DUCT-ADJUSTING SCREW UNIT FOR AN INK FOUNTAIN IN A PRINTING PRESS

[76] Inventor: Patric Albiez, St. Gallerstrasse, CH-8353, Elgg, Switzerland

[21] Appl. No.: 09/147,997

[22] PCT Filed: Sep. 25, 1997

[86] PCT No.: PCT/CH97/00363

§ 371 Date: Mar. 24, 1999

§ 102(e) Date: Mar. 24, 1999

[87] PCT Pub. No.: WO98/13202

PCT Pub. Date: Apr. 2, 1998

[30] Foreign Application Priority Data

Sep. 25, 1996 [CH] Switzerland ..... 2347/96

[51] Int. Cl.[7] ..... B41F 31/02; B41F 31/00

[52] U.S. Cl. ..... 101/365; 101/351.1

[58] Field of Search ..... 101/365, 350.1, 101/350.2, 350.6, 364, 351.1, 351.2, 351.3, 351.4

[56] References Cited

U.S. PATENT DOCUMENTS

| | | | |
|---|---|---|---|
| 590,790 | 9/1897 | Kayser | 101/365 |
| 1,798,042 | 3/1931 | Smith | 101/365 |
| 2,607,315 | 8/1952 | Leedy et al. . | |
| 4,051,782 | 10/1977 | Fernandez | 101/365 |
| 4,479,434 | 10/1984 | Armelin . | |
| 4,607,571 | 8/1986 | Takeuchi et al. | 101/365 |
| 5,031,533 | 7/1991 | Goodwin | 101/365 |
| 5,052,297 | 10/1991 | Albiez | 101/365 |
| 5,694,851 | 12/1997 | Bruni | 101/365 |

FOREIGN PATENT DOCUMENTS

| | | |
|---|---|---|
| 0 425 432 B1 | 6/1994 | European Pat. Off. . |
| 0 667 238 | 8/1995 | European Pat. Off. . |
| 25 50 720 | 6/1977 | Germany . |
| 33 36 919 A1 | 7/1984 | Germany . |
| 647 716 A5 | 2/1985 | Switzerland . |
| WO 94/19194 | 9/1994 | WIPO . |

*Primary Examiner*—Kimberly Asher
*Attorney, Agent, or Firm*—Pauley Petersen Kinne & Fejer

[57] ABSTRACT

An ink knife duct-adjusting screw unit for an ink fountain in a printing press, having a contact pressure bolt engaging in the bore hole of the housing of an ink fountain and acting upon the ink knife, and a device indicating the position of the duct-adjusting screw and having a control lever. The duct-adjusting screw unit has a modified adaptor element which can be inserted into the existing threaded bore holes of the housing of an existing ink fountain. The remaining elements of the duct-adjusting screw unit can be used according to the type of the machine.

9 Claims, 3 Drawing Sheets

INK KNIFE DUCT-ADJUSTING SCREW UNIT FOR AN INK FOUNTAIN IN A PRINTING PRESS

BACKGROUND OF THE INVENTION

1. Field of the Invention

This invention relates to a duct-adjusting screw unit, for an ink blade of an ink duct of a printing press, having a contact pressure bolt extending through a threaded bore of a housing of an ink duct and acting on the ink blade, and having a device indicating the position of the duct-adjusting screw with an actuating lever.

2. Description of Prior Art

With various printed products, the requirement for printing ink is often quite different over the entire width. It is thus desired that an ink supply from an ink duct to a ductor does not take place evenly, but rather as a function of the local need. Thus, the ink ductors of a printing presses have appropriate duct-adjusting screws, whose contact pressure bolts extend through a housing of the ink duct and press in an adjustable manner on an ink blade. With a basic design of most conventional printing presses, duct-adjusting screws are very simple screws having a screw thread, which can be manually screwed in and out for adjustment. One problem is that the adjustment of the duct-adjusting screw is time-consuming, and thus relatively great amounts of waste are generated. Accordingly, printing presses are often retrofitted by removing entire ink ducts and installing new ink ducts, which have duct-adjusting screws which can either be more accurately set or have appropriate indicator devices for immediately setting the same position of the duct-adjusting screws when a defined printing process is repeated. This is achieved most exactly with screwable displacement devices, which are coupled with a counter. Such systems are known, for example, from U.S. Pat. No. 2,607,315 or from European Patent Reference EP-A-0 425 432. Ink ducts with duct-adjusting screws displaced by pivotable levers and whose contact pressure position is thus visible from a position of the pivot lever, are somewhat less precise, but more quickly adjustable. Such systems are also known in various designs and reference is made in this context for example to PCT Reference WO-A-94/19194, U.S. Pat. No. 4,479,434, German Patent Reference DE-A-25 50 720 and German Patent Reference DE-A-33 36 919, as well as Swiss Patent Reference CH-A-647 716.

Practically all mentioned conventional solutions require appropriately adapted ink ducts, and only a few are known for retrofitting existing ink ducts, wherein the simple duct-adjusting screws are removed and replaced by appropriate, specially produced duct-adjusting screw units. One main problem is that there are no standards for ink ducts, and different ink ducts are employed with each model of a printing press and with almost all types of the same model. These systems only have in common that appropriate bores, through which the contact pressure bolt is guided, are provided in the housings of the ink ducts. Depending on the system, the bores are of different length, have various diameters and are either simple bores or threaded bores. In many cases there are changes in the diameter within the bore. Accordingly, to retrofit existing ink ducts, it would require type-specific, specially manufactured different duct-adjusting screw units, wherein changes would also have to be made in the housings of the ink ducts. The adaptation of a printing press is therefore also correspond ingly expensive. With conventional systems it is either necessary to attach a completely new ink duct with appropriate duct-adjusting screw units, or the press to be retrofitted is idle for an extended time, because the existing ink duct must be removed, bores changed, the duct-adjusting screw units inserted and the ink duct reinstalled. This requires a long retrofitting time, during which an accompanying work loss additionally increases costs.

As Applicant learned from own experience, an enormous number of different basic types are necessary for retrofitting the printing presses on the market. Accordingly, warehouse expenses are high.

SUMMARY OF THE INVENTION

It is thus one object of this invention to produce a duct-adjusting screw unit, for more easily retrofitting existing printing presses without having to change ink ducts, so that a printing press operator can mount duct-adjusting screw units without making corresponding changes in an existing ink duct.

This object is attained by a duct-adjusting screw unit having the characteristics set forth in the claims and described in the specification.

BRIEF DESCRIPTION OF THE DRAWINGS

One preferred exemplary embodiment is schematically represented in the drawings and will be explained in the following description wherein.

DESCRIPTION OF PREFERRED EMBODIMENTS

Figure 1:
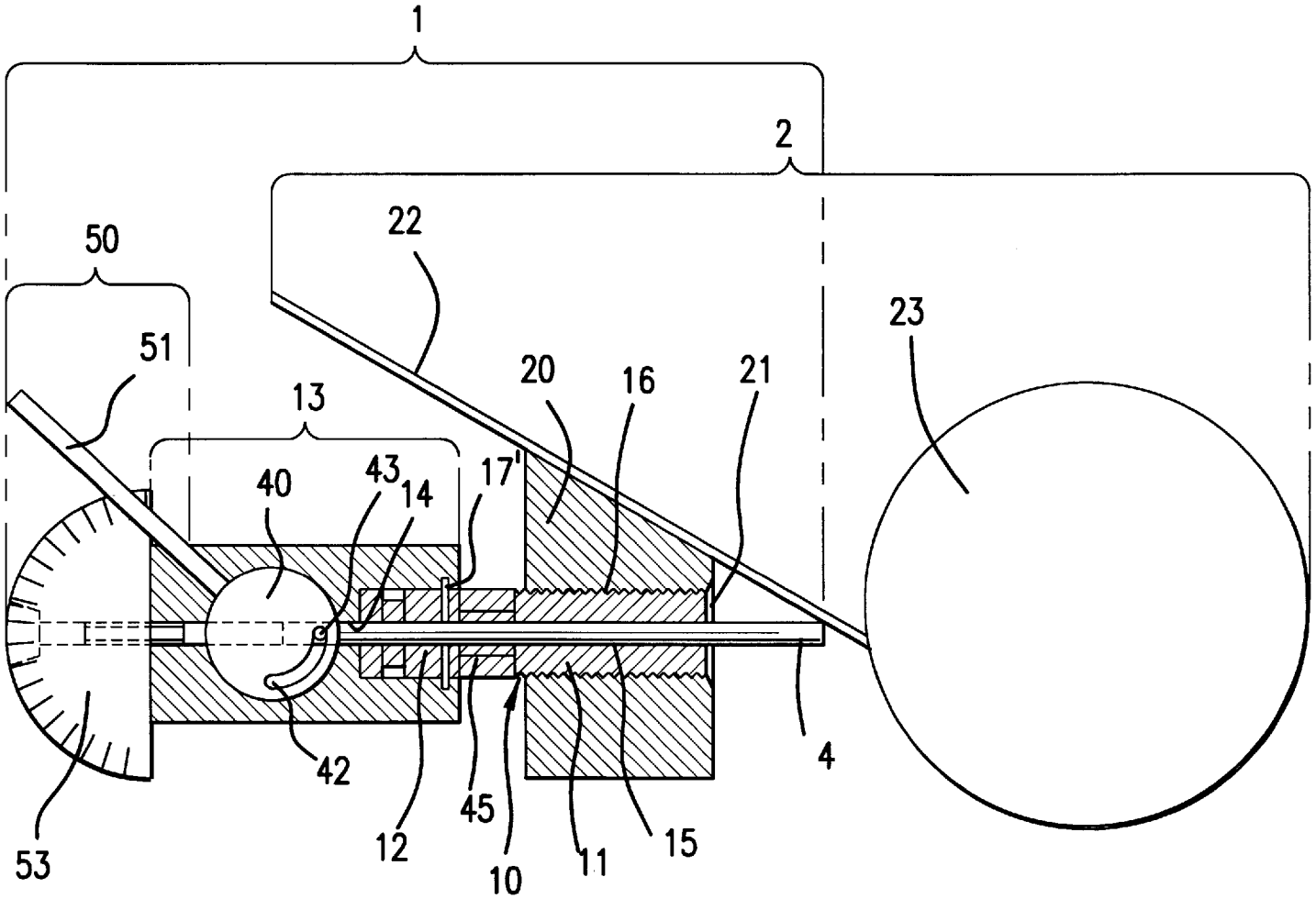
FIG. 1 is a vertical sectional view of a duct-adjusting screw unit taken perpendicularly with respect to an axis of a ductor.
Figure 1A:
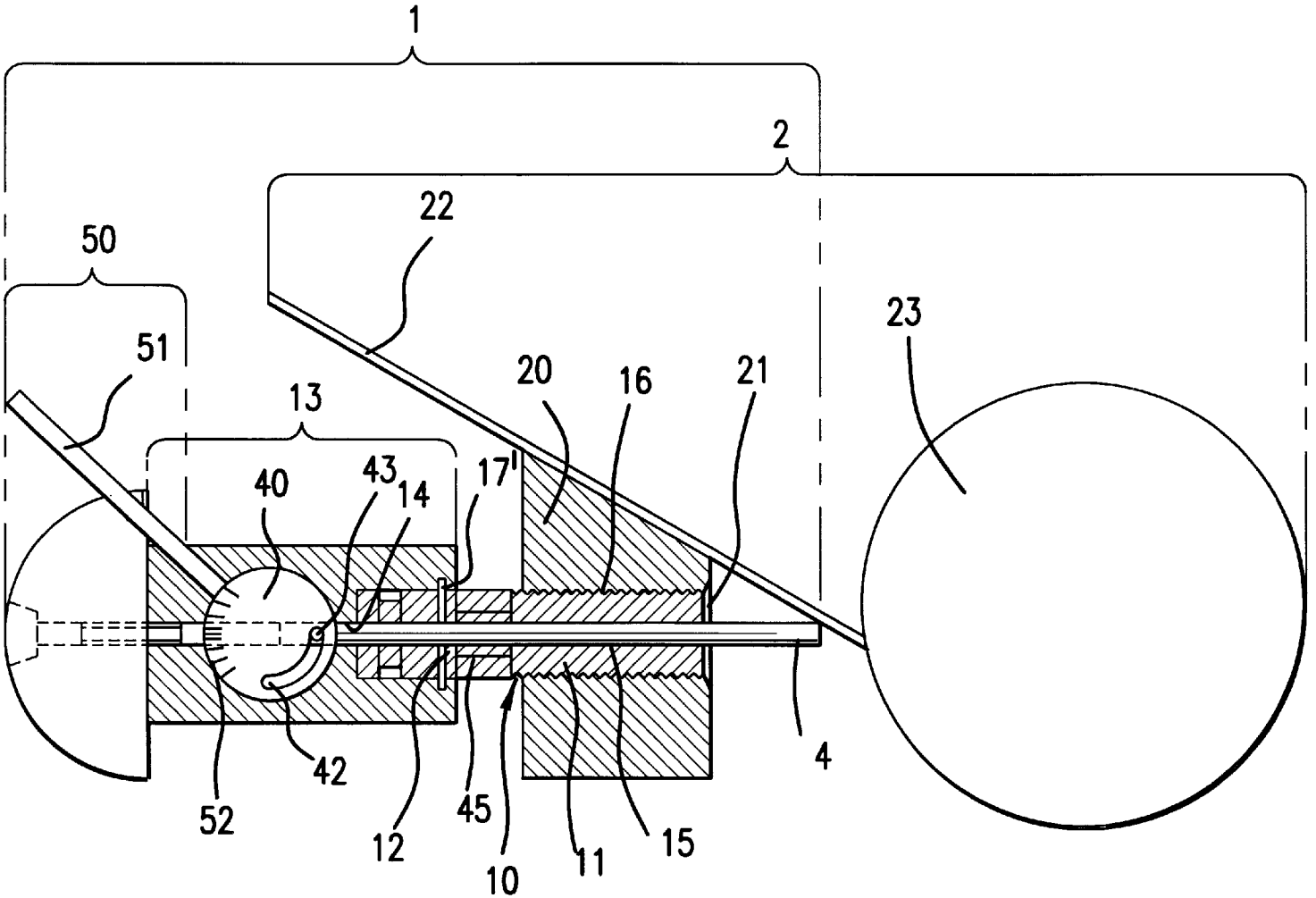
FIG. 1A is a vertical sectional view of a duct-adjusting screw unit taken perpendicularly with respect to an axis of a ductor, according to another preferred embodiment of this invention.
Figure 2:
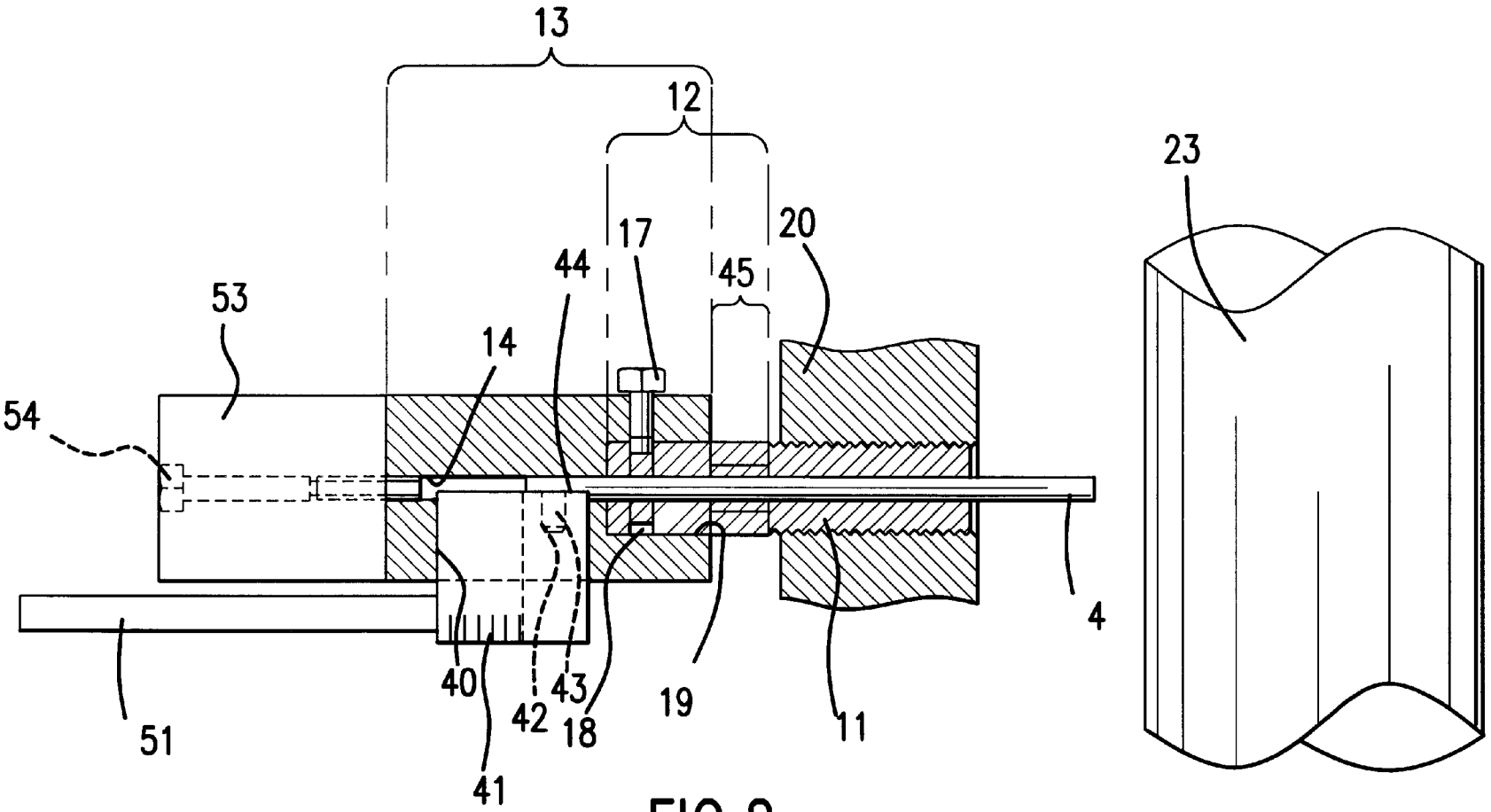
FIG. 2 is a horizontal sectional view of the same duct-adjusting screw unit but taken parallel with a direction of extension of a ductor axis.

As previously mentioned, this invention is designed for an existing ink duct of any arbitrary printing press. These elements are therefore represented in a purely schematic fashion. The actual design can be much more complex, however, this is irrelevant to this invention, since only one element need be matched to these existing conditions.

Every conventional printing press has an ink duct 2 which includes a housing 20 with a plurality of bores, mainly threaded bores 21, through which duct-adjusting screws extend. The duct-adjusting screws act directly on an ink blade 22, which rests against a ductor 23. The ink present at the ductor 23 is intermittingly lifted off by a vibrator and transferred to an ink roller of an ink unit.

A plurality of bores 21 are provided with regular spacing in the housing 20 of the ink duct 2. The shape, diameter, length and extension of the bores 21 is extremely different between presses, depending on the particular press.

Instead of adapting the ink duct to a new duct-adjusting screw unit, or even to install a completely new ink duct, the duct-adjusting screw unit is divided basically into two areas, an area which remains the same and an adapted, type-specific area, such as an adapter element 10.

The adapter element 10, as shown in FIG. 1, comprises a two-piece cylindrical sleeve. The sleeve has a threaded element 11 and a plug element 12. The nomenclature threaded element and plug element are merely used to differentiate the elements and corresponds to the exemplary embodiment shown in the drawings. The threaded element 11 is adapted in its design and dimensions to the conditions present in the existing housing 20 of the ink duct 2 to be equipped. The threaded element 11 of the adapter 10 is therefore customized. In contrast, the plug element 12 of the adapter 10 is standardized and fits the unchanged remaining part of the duct-adjusting screw unit 1. The first element of the adapter element 10, here designed as the threaded element 11, has a lesser diameter than the plug element 12, in most occurring cases.

The plug element 12 is a cylindrically turned element, which can be pushed with pass fit into an adjusting block 13. The adjusting block 13 preferably has a cuboid shape and has a cylindrical through-bore 14. A contact pressure bolt 4 is seated in the through-bore 14. The contact pressure bolt 4 extends almost completely through the adjusting block 13 and extends centered through the entire adapter element 10, until it rests against the ink blade 22. The adapter element 10 accordingly also has a bore 15 with a diameter of the same dimension, which extends completely through the adapter element 10.

The threaded element 11 of the adapter element 10 has an exterior thread 16, which is matched to the existing interior thread in the bore 21 of the housing 20 of the ink duct 2. Thus the entire duct-adjusting screw unit 1 is releasably connected with the ink duct 2 and is also adjustable with respect to the ink duct 2. As represented here, the connection between the adjusting block 13 and the adapter element 10 can be provided by means of a fixation screw 17, which engages a circumferential recess 18 on the plug element 12 of the adapter element 10. The fixation screw 17 laterally extends through the adjusting block 13 as far as a widened bore 19.

The length and diameter of the widened bore 19 are precisely matched to the plug element 12 of the adapter element 10. As long as the fixation screw 17 is not tightened, the adapter element 10 is secured in the axial direction, but is still rotatable, which is useful for mounting and rough adjustment. The plug element 12 can also be fixed in place in the adjusting block 13 with appropriate recesses cut into both elements for an only limitedly releasable connection using a Seger ring 17', by means of which an axial fixation is also achieved, while the rotatability of the two elements with respect to each other remains assured. This alternative is shown in a simplified form in FIG. 1.

A seating bore 40, which extends at least as far as into the through-bore 14, is cut into the adjusting block 13 vertically with respect to a direction of extension of the cylindrical through-bore 14. A pivot body 41 is rotatably seated and axially secured in the seating bore 40, designed as a blind bore. Axial securing can occur by conventional means, for example by means of a Seger ring.

On a front face located toward the cylindrical through-bore 14, the pivot body 41 has an eccentric link track 42, which is at least partially formed as a section of a circle. A catch 43 fastened on the contact pressure bolt 4 engages the link track 42. Thus, a rotating movement of the pivot body 41 leads to an axial displacement of the contact pressure bolt 4.

In order to improve guidance of the contact pressure bolt 4 and the pivot body 41 in the contact area, and also to prevent tilting of the catch 43 in the link track 42, the contact area of the contact pressure bolt 4 is ground to form a flat sliding face 44. The length of the flat sliding face 44 corresponds to at least a diameter of the pivot body 40 plus the maximum displacement of the contact pressure bolt 4.

The pivot body 40 also projects laterally out of the adjusting block 13 which accommodates an actuating lever 51, which is arranged radially on the pivot body 40. Basically, the actuating lever 51 indicates by means of its angular position a position of the contact pressure bolt 4 with respect to the ink blade 22. However, the indication can also be provided by a graduation 52 on the pivot body 41, for reading off its angular position with respect to the adjusting block 13. The setting is considerably more visible, however, if an element 53 having a graduation is screwed to the adjusting block 13. In the embodiment in accordance with FIG. 1 the element 53 is a cylinder calotte with an appropriate read-off graduation. The element 53 can also approximate a shape of a plate. The element 53 with the graduated scale for indication is fixed interchangeably by means of a screw 54. The screw 54 directly engages the cylindrical through-bore 14, which has an interior thread at the end.

The element 53 with the graduation can also be designed in a press-specific manner. For example, the element 53 with the graduation can have exactly the width corresponding to the spacing between two neighboring duct-adjusting screw units. In this case, the element 53 is wider than the adjusting block 13, or respectively wider than the entire width of the remaining duct-adjusting screw unit 1 without the element 53. In the completely retrofitted state, the elements supporting the graduation lie closely next to each other.

Mounting the duct-adjusting screw units 1 in accordance with this invention is performed such that the adapter element 10, which is produced in a press-specific manner, is screwed into an approximately correct position by means of its threaded section and the remainder of the unit is placed on the plug element 12 of the adapter element 10. A tightening area 45, provided in an advantageous manner, remains accessible on the adapter element 10 and is used to tighten the adapter element 10 by means of a tool, for example an open-end wrench. Accordingly, the tightening area 45 can be hexagonal or octagonal.

For a first adjustment, the pivot body 41 is set to a minimal position by means of the actuating lever 51, and thereafter the adapter element 10 is screwed in with the aid of an open-end wrench until a pressure of the contact pressure bolt 4 against the ink blade 22 is so great that practically no ink can be passed. By pivoting the actuating lever 51 it is therefore possible to adjust ink delivery to the ductor 23 from a minimum to a maximum. This setting is easily recognizable, and can be easily set and read off, so that the same setting can be immediately repeated for a new printing process. An experienced printing press operator can determine by means of the material to be printed alone which setting is at least approximately appropriate for correct ink delivery.

I claim:

1. In a duct-adjusting screw unit (1) for an ink blade (22) of an ink duct (2) of a printing press, having a contact pressure bolt (4) extending through a bore of a housing (20) of the ink duct (2) and acting on the ink blade (22), and having a device (50) indicating a position of the duct-adjusting screw unit (1) with an actuating lever (51), the improvement comprising: the duct-adjusting screw unit (1) having a matched adapter element (10), the housing (20) having a threaded bore (21), the matched adapter element (10) insertable within the threaded bore (21), a remaining element of the duct-adjusting screw unit (1) adaptable to the printing press, and the adapter element (10) having a one-piece cylindrical sleeve having a threaded element (11) with an outer thread (16) adapted to the threaded bore (21), and having a plug element (12) for connection with the remaining element of the duct-adjusting screw unit.

2. In the duct-adjusting screw unit in accordance with claim 1, wherein an adjusting block (13) has a through-bore (14), the remaining element of the duct-adjusting screw unit (1) comprises a contact pressure bolt (4) which extends through the adapter element (10) and is slidingly seated within the through-bore (14), the adapter element (10) is axially securely seated with the plug element (12), and an actuating mechanism (40 to 50) axially displaces the contact pressure bolt (4) with respect to the ink blade (22).

3. In the duct-adjusting screw unit in accordance with claim 2, wherein the plug element (12) of the adapter element (10) is secured against axial displacement in the adjusting block (13) by a Seger ring (17').

4. In the duct-adjusting screw unit in accordance with claim 2, wherein an interchangeable graduated element (53) is screwed to the adjusting block (13).

5. In the duct-adjusting screw unit in accordance with claim 1, wherein a graduated indicator element is screwed to the adjusting block (13 ).

6. In the duct-adjusting screw unit in accordance with claim 1, wherein a tightening area (45) is provided between the threaded element (11) and the plug element (12) of the adapter element (10) for screwing-in and setting the adapter element (10) with a tool.

7. In a duct-adjusting screw unit (1) for an ink blade (22) of an ink duct (2) of a printing press, having a contact pressure bolt (4) extending through a bore of a housing (20) of the ink duct (2) and acting on the ink blade (22), and having a device (50) indicating a position of the duct-adjusting screw unit (1) with an actuating lever (51), the improvement comprising: the duct-adjusting screw unit (1) having a matched adapter element (10), the housing (20) having a threaded bore (21), the matched adapter element (10) insertable within the threaded bore (21), a remaining element of the duct-adjusting screw unit (1) adaptable to the printing press, and the adapter element (10) having a one-piece cylindrical sleeve having a threaded element (11) with an outer thread (16) adapted to the threaded bore (21), and having a plug element (12) for connection with the remaining element of the duct-adjusting screw unit an adjusting block (13) having a longitudinal through-bore (14) in which a contact pressure bolt (4) is seated, and having a widened bore (19) widened concentrically toward the adapter element (10), the widened bore (19) receiving the plug element (12), the adjusting block (40) having a second seating blind bore (40) extending vertically with respect to the longitudinal through-bore (14), a cylindrical pivot body (41) secured axially and rotatably seated in the second seating blind bore (40), the pivot body (41) having an eccentric link track (42) engaged by a catch (43) fastened on the contact pressure bolt (4).

8. In the duct-adjusting screw unit in accordance with claim 7, wherein an actuating lever (51) acts on a portion of the cylindrical pivot body (41) which extends out of the adjusting block (13).

9. In the duct-adjusting screw unit in accordance with claim 7, wherein in a contact area with the pivot body (41) the contact pressure bolt (4) has a flat sliding face (44) and the catch (43) is arranged on the sliding face (44) vertically with respect to the sliding face (44).

* * * * *